United States Patent [19]

Waterhouse et al.

[11] 3,943,222

[45] Mar. 9, 1976

[54] MANUFACTURING TEXTILE YARNS

[75] Inventors: George Waterhouse, Macclesfield; Walter Parker, Wilmslow, both of England

[73] Assignee: Ernest Scragg & Sons Limited, Macclesfield, England

[22] Filed: July 16, 1973

[21] Appl. No.: 379,216

Related U.S. Application Data

[63] Continuation of Ser. No. 48,054, June 22, 1070, abandoned.

[30] Foreign Application Priority Data

June 27, 1969 United Kingdom ..... 32680/69

[52] U.S. Cl. ..... 264/147; 264/210 R; 264/235; 264/284; 264/DIG. 47

[51] Int. Cl.[2] B29C 17/02; D01B 9/00; D01D 11/00

[58] Field of Search ..... 264/DIG. 47, 249, 210 R, 264/178, 235, 284

[56] References Cited

UNITED STATES PATENTS

| | | | |
|---|---|---|---|
| 1,756,328 | 4/1930 | Andelin | 425/337 |
| 2,728,950 | 1/1956 | Annesser | 264/DIG. 47 |
| 3,066,366 | 12/1962 | Wyckoff et al. | 264/178 X |
| 3,137,746 | 6/1964 | Seymour et al. | 264/DIG. 47 |
| 3,253,072 | 5/1966 | Scragg et al. | 264/DIG. 47 |
| 3,257,488 | 6/1966 | Rasmussen | 264/DIG. 47 |
| 3,273,329 | 9/1966 | Scragg | 264/DIG. 47 |
| 3,324,217 | 6/1967 | Armstrong et al. | 264/210 R |
| 3,427,912 | 2/1969 | Nozawa et al. | 264/DIG. 47 |
| 3,454,455 | 7/1969 | Rasmussen | 264/DIG. 47 |
| 3,488,415 | 1/1970 | Patchell et al. | 264/DIG. 47 |
| 3,496,259 | 2/1970 | Guenther | 264/DIG. 47 |
| 3,500,517 | 3/1970 | Dekker et al. | 264/DIG. 47 |
| 3,500,627 | 3/1970 | Kim | 264/DIG. 47 |
| 3,511,901 | 5/1970 | Brown | 264/DIG. 47 |
| 3,527,393 | 9/1970 | Matsui et al. | 264/DIG. 47 |
| 3,546,221 | 12/1970 | Johnson | 264/249 |

OTHER PUBLICATIONS

Marshall, I. and A. B. Thompson, "The Cold Drawing of High Polymers," In Proc. Roy. Soc. (London), Series A, No. 1147, Vol. 221. Feb. 9, 1954, pp. 541–557.

Muus, Laurits T.; N. Gerard McCrum and Frank C. McGrew, "On the Relationship of Physical Properties to Structure in Linear Polymers of Ethylene and Propylene," In Spec. Journal, May, 1959, pp. 368–372.

Gezovich, D. M. and P. H. Geil, "Morphology of Quenched Polypropylene," In Polymer Engineering and Science, July, 1968, Vol. 8, No. 3, pp. 202–209.

Gezovich, D. M. and P. H. Geil, "Deformation and Aging of Quenched Polypropylene," In Polymer Engineering and Science, July 1968, Vol. 8, No. 3, pp. 210–215.

Werner, A. C. and J. J. Krimm, "Forging High Molecular Weight Polyethylene," In Spe. Journal, Dec. 1968, Vol. 24, pp. 76–79.

Billmeyer, Fred W., Textbook of Polymer Science, New York, Interscience, C 1964, pp. 164–166.

Whittington, Lloyd R., Whittington's Dictionary of Plastics, Stamford, Conn., Technomic, C 1968, pp. 238–239.

Encyclopedia of Polymer Science And Technology, Vol. 12, Section: "Stamping," New York, Interscience, c 1970, pp. 768–771.

*Primary Examiner*—Philip Anderson

*Attorney, Agent, or Firm*—Larson, Taylor & Hinds

[57] ABSTRACT

In the manufacture of textile yarns from synthetic thermoplastic materials, such as polyamides, polyesters and polyolefins, e.g. polypropylene, a web or sheet of the material, which may be preformed or formed by extrusion or casting as a step in a continuous process, is subjected to "forging" as by a profiled roller to produce in the web or sheet parallel lines of weakness and then to such a drawing operation in a direction parallel to the lines of weakness that the web or sheet is stretched to many times its original length and, with or without assistance of other mechanical means, is thereby split into discrete, thin filaments suitable for textile yarns. 5 1 1 Anderson; Philip 1 4

13 Claims, 20 Drawing Figures

MANUFACTURING TEXTILE YARNS

Figure 1:
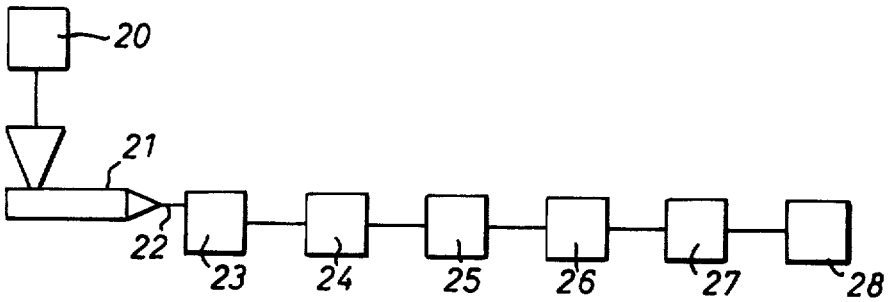

This is a continuation of application Ser. No. 48,054, filed June 22, 1970, now abandoned.

This invention relates to manufacturing textile yarns of materials, such as polyamides, polyesters, polyolefins and the like, which are formable into sheets or webs capable of being converted into filaments by division into narrow strips and stretching to many times their original length. Such materials are referred to herein as synthetic materials of the class specified.

According to this invention, filaments for textile yarns are produced from synthetic material of the class specified by subjecting a sheet or web of the material to forging to effect local weakening along parallel lines and thereafter effecting division of the sheet or web along the lines of weakness with simultaneous stretching.

By forging, as used herein, is meant a treatment carried out by passing the sheet or web into contact with a profiled roller, at a temperature at which the material is plastic and such that the thickness of the sheet or web is greater locally reduced to produce the lines of weakness by simultaneous deformation and plastic displacement of material laterally into the regions between the lines of weakness.

The division of the sheet or web along the lines of weakness may be caused by rupture due to drawing, that is stretching of the sheet or web in the direction of the lines of weakness, but may also be augmented by lateral stretching, or mechanically by slitting or by passing the stretched sheet or web over a saw-tooth surface.

The foregoing operations may be effected on a previously-formed sheet or web in which case the sheet or web is for instance drawn from a reel and passed under a constant low tension and in a flat stress-free condition to a pre-heater to render the material sufficiently plastic for the forging to be effective.

Alternatively the forging and division of the sheet or web into filaments may be steps in a continuous process in which the sheet or web is formed and then is converted into filaments. In one such process, the synthetic material in a plastic condition is extruded from a die orifice directly on to a relatively chilled forging roller of appropriate profile to produce a web having longitudinal lines of weakening, the web then passing to a driving mechanism to be appropriately stretched. In another such process a continuous web is formed by casting, the molten material being extruded through an elongate orifice on to a chill roll or into a cooling bath and the web being drawn to the required dimensions before the point at which the material freezes. The web so formed then passes to the forging and stretching stages.

Clearly, if desired, the filaments produced may be passed to further processing stages such as are now typically carried out on continuous textile filaments made from synthetic materials of the class specified.

Figure 2:
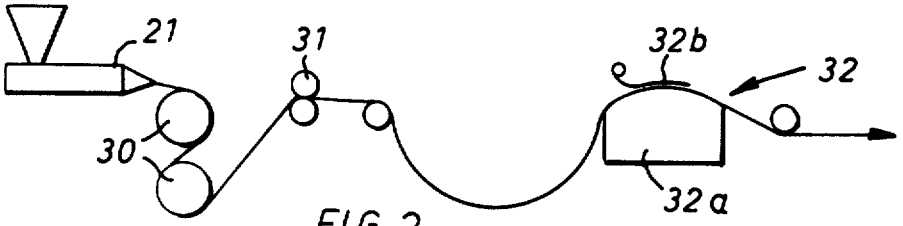
Figure 3:
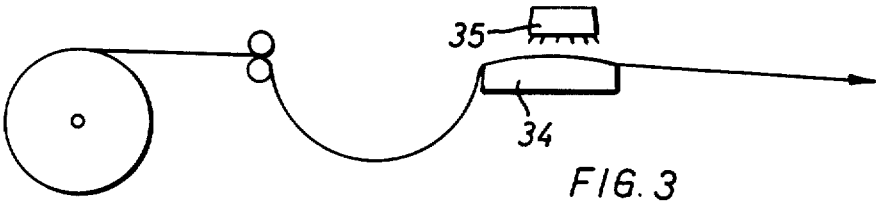
Figure 4:
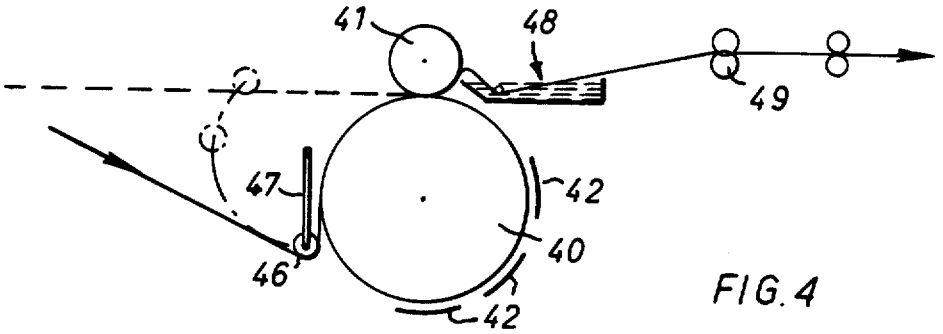
Figure 5:
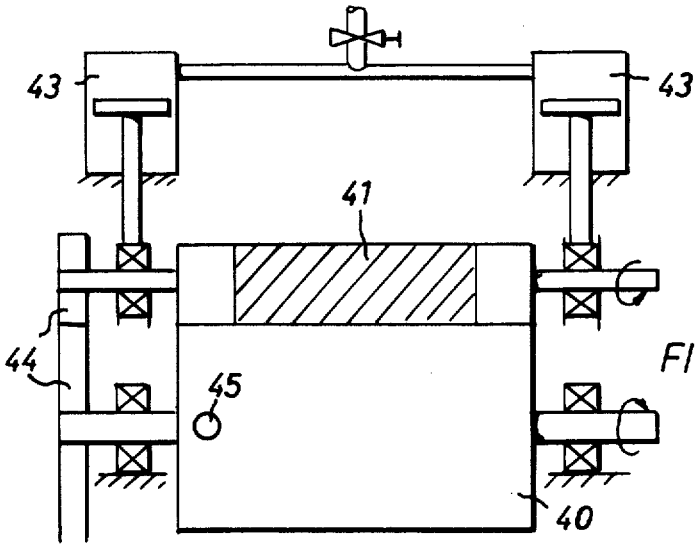
Figure 6:
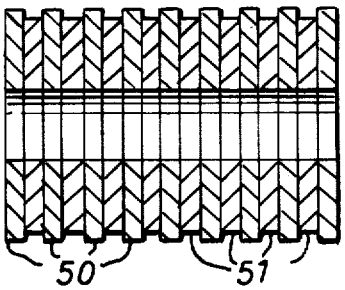
Figure 7:
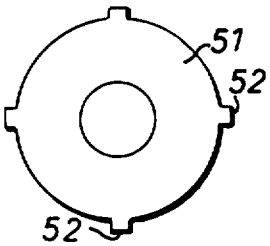
Figure 8:
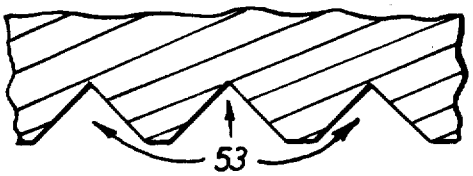
Figure 9:
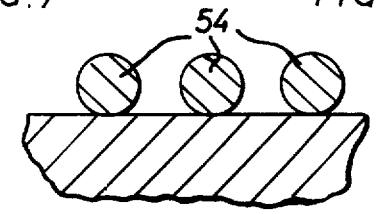
Figure 10:
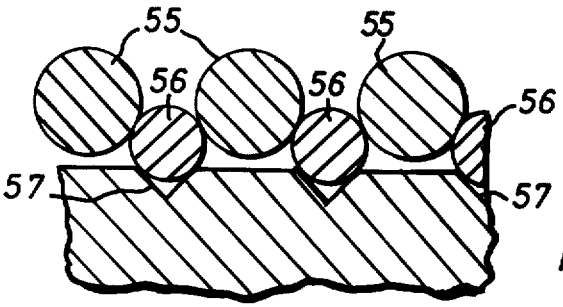
Figure 11:
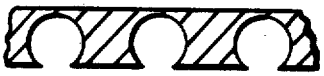
Figure 12:
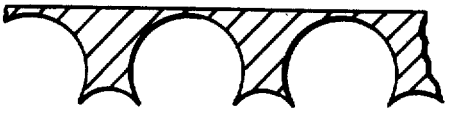
Figure 13:
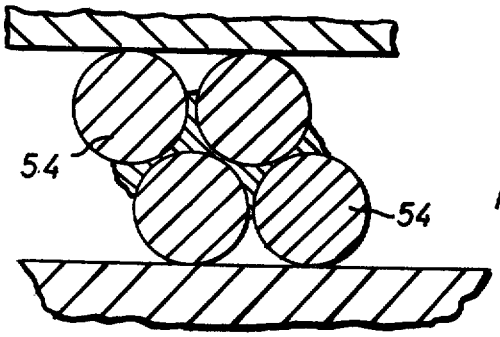
Figure 15:
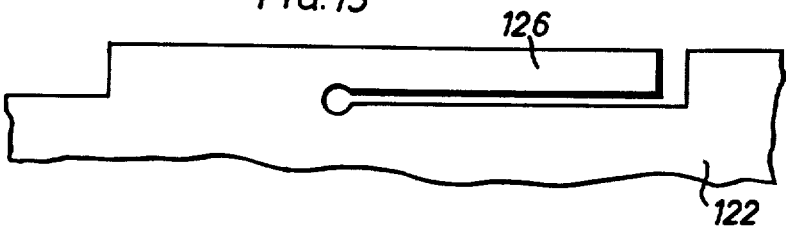
Figure 16:
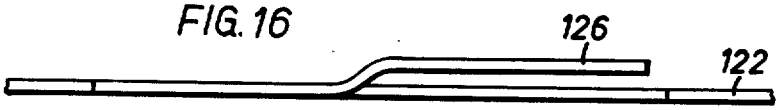
Figure 17:
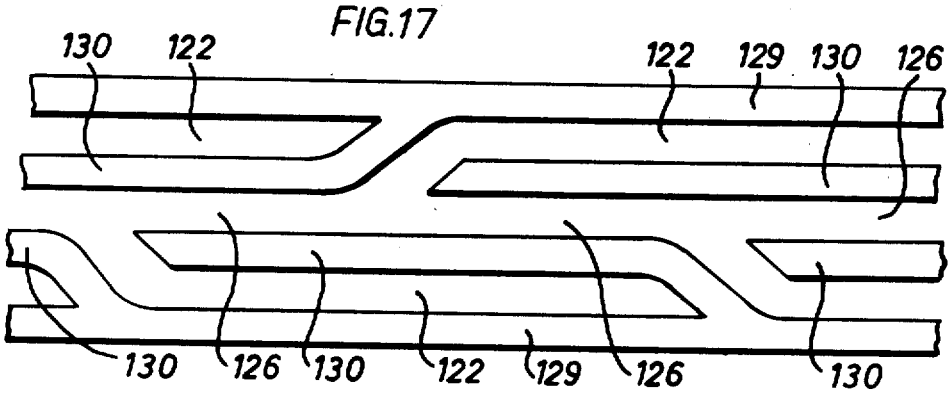
Figure 18:
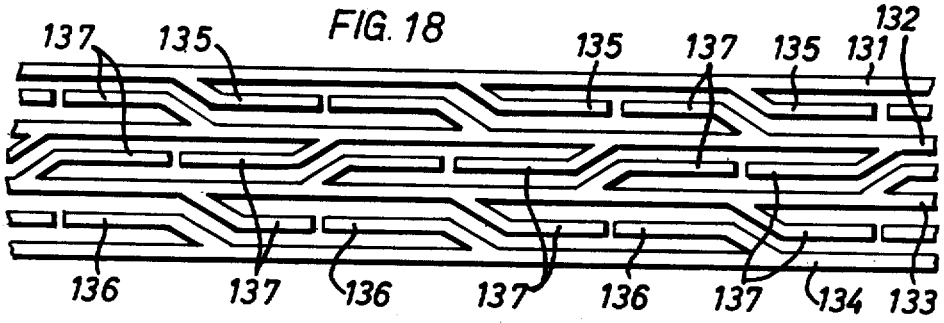

The following description sets out in more detail some ways in which the invention may be carried out, and the description makes reference to the accompanying drawings, in which:

FIG. 1 is a block diagram of one continuous process for producing filaments from granules of a thermoplastic synthetic material, FIG. 2 illustrates diagrammatically initial steps in the process, FIG. 3 illustrates diagrammatically alternative initial steps starting with a reeled web, FIG. 4 illustrates intermediate stages in the processing of a continuous web to form filaments, FIG. 5 illustrates a form of apparatus suitable for use in one of the stages of FIG. 4, and FIG. 6 is an axial section through one form of forging roller, FIG. 7 illustrates a modification of part of such roller, FIGS. 8, 9 and 10 illustrate other forms of roller, FIGS. 11, 12 and 13 illustrate the cross-sections of webs forged with rollers of FIGS. 9 and 10, FIGS. 14, 15 and 16, 19 and 20 illustrate the construction of other forms of forging roller, and FIGS. 17 and 18 are diagrammatic plan views of forged webs.

Referring first to FIG. 1, the illustrated process comprises feeding granules of the selected synthetic material from a storage 20 to an extrusion stage 21 wherein the material is heated to a molten condition and is then forced through an elongate extrusion orifice 22 to a casting stage 23 in which the molten film from the extrusion orifice is quenched rapidly and drawn down to the required size before the material freezes. The web so formed, after edge trimming to avoid difficulties in later stages due to thick edges, is next passed through a tensioning unit 24, in which preheating may also be effected if necessary, to a forging stage 25 which is followed by drawing and annealing stages 26, 27 whereafter resulting yarn is wound into packages at 28.

The material selected for processing must be capable of plastic flow when subject to stress and preferably the material is a thermoplastic, i.e. capable of softening and melting on heating and solidifying on cooling, the process being capable of repetition without appreciable change in properties. Examples of such materials are organic polymerisation products and are usually obtainable in a powder or granule form. A typical polymer is polypropylene and reference will be restricted to this material in the following description.

Several grades of polypropylene are available from various manufacturers but reference will be restricted to the Shell Chemical Co's product known as "Carlona" P KZ61, which is a homopolymer stabilised against thermal degradation and oxidation. Melt index is 3.0 (BS 2782 part 1, 1956; method 105C; 250° C, 2.16Kg loading) gm/10 min., density 0.905 (BS 2782 part 5, 1958; method 509A), melting point range 165°–175° C and available in granules.

In the process stage 20, 21, the granules are converted to a continuous web by melting the granules and forcing the molten polymer through the elongate orifice 22. A suitable extrusion apparatus is a single-screw extruder with a length/diameter ratio greater than 15:1 and a compression ratio greater than 2.5:1; the temperature gradient should be such as to give a melt temperature between 250° and 270° C.

The geometry of the orifice 22 is dependent upon extruder throughput and take-off speed. To produce a 50 mm wide web of film of thickness 75$\mu$ at a speed of 8 meters/min. and a rotational speed of 80 r.p.m. with a screw 18 mm diameter and 24 length/diameter ratio, the orifice is 60 mm wide and 0.5 mm high.

The film leaving the orifice 22 is cast at 23 either on to a highly polished, water-cooled, chill roll or rolls 30 (FIG. 2), or into a water bath. Chill roll casting is preferred. The molten film is drawn from the chill rolls 30 by rollers 31 and during this travel the film is drawn down to form a web of the required dimensions.

Because rapid quenching is required to avoid the growth of large spherulite crystals, intimate contact between film and chill roll is necessary and this is achieved by an air knife. After freezing, the edges of the film are cut away leaving a film of width 40 mm and thickness 75$\mu$. By using a polished chill roll, one side of the film is polished giving rise to advantages in a later stage.

If a non-continuous process is desired, the process may now be interrupted and the web reeled up for storage. If stored, the reel must be kept cool but should not be stored for longer than about 2 to 3 days because crystallisation will continue during storage and the web will become brittle; this will lead to frequent breakdown during the drawing stage 26 and to low-tenacity end-products.

The continuous web emerging directly from the casting stage 23, or from reel storage, should be fed into the forging stage 25 under constant low tension and in completely flat, stress-free form. The directly-fed web is in this condition and can be passed to the forging stage through a simple tensioner 32, usually without pre-heating. The tensioner 32 may take many forms, a simple form being a saddle 32*a* with drag-strip 32*b* as indicated in FIG. 2. Very accurate tension control is achieved with electrostatic or hysteresis tensioners.

Reeled web will have relaxed during storage and must be passed over a smooth, heated surface 34 (FIG. 3) to relieve the stresses whilst passing, or before or after passing through say an electrostatic tensioner 35.

The required tension is below that which would cause drawing of the web in the forging stage 25.

The temperature to which the web is pre-heated, or has when entering the forging stage 25, is about 100° C.

The forging stage 25 creates in the web areas of weakness and determines the cross-section of the filaments produced. In this stage, the web is warmed to a temperature below its melting point (in order to increase its plasticity) and selectively deformed causing the material in selected areas to be displaced thereby reducing the web thickness and simultaneously forcing the displaced material to enter, and preferably fill, the spaces between the forging means.

The forging means is conveniently formed by two rotating rollers, usually one plain or support roller 40 and one profiled roller 41, (FIGS. 4 and 5) although both may be profiled for certain end-product requirements. The roller axes are parallel and the forging action takes place in the nip between the rollers as they rotate in contra-directions. The protruding portions of the profiled roller or rollers impart the disturbing forces to the material, the depressions serving both as sinks for displaced material and moulds to create the yarn profile.

Both rollers 40, 41 are heated as by radiant electric heaters 42 or for more accurate control by the use of circulating hot oil. The temperature of the support or counter roller may be monitored by a surface thermocouple 45 controlling a power regulator. The rollers are pressed into contact by pneumatic or hydraulic cylinders, are connected by gearing 44 and are power driven by a variable speed motor/gearbox arrangement adjusted to match extruder throughput.

In one example, a polypropylene web travelling at 8 metres/min. is forged under the following conditions.

The counter roller 40 has a circumference of 40 cm and is rotated at 20 r.p.m. and the profiled roller 41 has a circumference of about 13 cm and is driven at 60 r.p.m. The web is constrained to maintain contact with the roller 40 for about 1 second. It is found that if the temperature of the roller 40 is about 135° C, the web will acquire a temperature suitable for forging. As used herein, a forgeable condition is that at which a thermoplastic material can flow under the force available.

In FIG. 4, the web is shown as being laid on the counter roller 40 by an idling roller 46 which is mounted on a pivoted arm 47 so that the amount of pre-heating can be varied. This particularly helps in threading up the nip and preventing overheating if a slow start speed is desirable. It is arranged that the smoother side of the web contacts the counter roller. This ensures rapid heat transfer particularly if the counter roller has a polished finish. The forging roller should have a similar finish to facilitate stripping of the cooled forged web in order to prevent low temperature drawing.

The profiled roller 41 is maintained at between about 70° C and 100° C which ensures that the profiled web, which tends to stick to the roller 41, is immediately chilled after passing the nip of the rollers and before being stripped from the roller 41. The chilling prevents uncontrolled flow of the polypropylene after passing the nip, but too rapid chilling should be avoided.

If both rollers are profiled, the cooler roller should have the deeper surface relief so that the web tends to maintain contact with it rather than with the warmer roller.

When the web leaves the profiled roller 41 the polypropylene is still hot enough for crystallisation to occur. Such crystallisation can be inhibited by passing the web through a cold water bath 48 to reduce the web temperature to the ambient temperature.

Under the forging conditions above described, the rollers 40, 41 are forced together with a total thrust of 200 lbs. At lower temperatures, higher pressures are required for instance up to 4000 lbs. Lower temperatures however affect the flow of the polypropylene from the weakened areas and the material tends to fold into the relieved spaces of the profiled rollers; such technique is however utilisable for producing arcuate tape-like filaments.

As will be clear from the various forms of forging roller described herein, the areas of weakness formed are in parallel lines extending longitudinally of the web.

The crystals of polypropylene in the chilled web leaving the forging stage 25 are essentially unoriented, but any orientation which exists is transverse to the length of the web and this has the effect of increasing the tenacity of the filaments finally produced as compared with conventional extruded filaments.

In the drawing stage 26, the latent filaments are drawn down to their correct size and separated by stretching the web under controlled tension and temperature conditions. If the forged web is sufficiently thin in the weakened regions, the web may split along the lines of weakening, as a result of the drawing operation, but if desired splitting may be assisted by mechanical means, for example by passing the drawn material over one or more saw-tooth surfaces which operation has the effect that lower forging pressures are required than if completion of splitting is to be achieved during drawing. The use of such mechanical means also enables the filaments to be released in bundles so that a friction false-twisting operation can be readily effected so completing separation and simultaneously imparting bulk to the yarn produced if the filaments are maintained at their drawing temperature.

The drawing apparatus may comprise two godet sets separated by an oven in which thermostatically-controlled air is recirculated. For Carlona P KZ61 as mentioned above the oven or air temperature should be 165° C ± 2°C and the "draw ratio" should be at least 1:10 and not more than 1:13. With such draw ratios filaments of 0.001 inch thickness and connecting material thickness of the order of 0.0001 inch can be obtained.

If desired division of the parent web can be commenced before drawing, for example by passing the web over cylindrical knife splitters between the casting and forging stages or as shown at 49 in FIG. 4 between the forging and drawing stages. If for instance bundles of 100 filaments are required the knives may be set 0.3 inch apart.

From the drawing stage 26 the discrete filaments are subjected to annealing at 27 (FIG. 1), for instance by passing them through a further oven and godet set, the oven being at a slightly higher temperature than the drawing oven, e.g. 1° or 2° higher, and the godet being set to allow the filaments to relax so inhibiting subsequent shrinkage. The filaments are then led to a winding stage 28 and are for instance separated into appropriate yarn counts and cross-wound into packages of desired size and weight.

In a modification of the above process a laminate, of say two different grades of polypropylene, is produced and fed to the forging and subsequent stages so producing a self-crimp in the filaments.

There will now be described several forms of forging roller.

For instance in FIG. 6, the roller is arranged to produce a square, or other rectangular, section filament, and is shown as being made up from two diameters of plain annular discs 50, 51, which are assembled in alternating relation. Typically the discs may be 50 microns thick and have a diameter difference of 75 microns and, in use, will have a "forging" action on the sheet or web, not a cutting or slitting action.

In FIG. 7 is shown a modification of the smaller diameter disc 51 of which the periphery has circumferentially spaced projections 52. The projections 52 cause periodic interruption of the latent filament formation so that the filaments, produced by subsequent drawing and chopping have a finite staple length.

Such a roller may be alternatively produced as follows:

Two batches of shim material, one of aluminium 0.003 inch thick, the other stainless steel 0.0015 inch thick are stamped to produce a plurality of torus-shaped discs which are threaded alternately on to a hardened steel shaft. About 700 of these are assembled and then clamped between two steel flanges. The whole assembly is then ground with a Norton 38A 150 - H5VBE white aluminium oxide wheel to a final diameter of 4.15 inches. The periphery of the cylinder formed by the shim assembly is then immersed in 15% caustic soda solution and continuously rotated to cause the whole surface to be sequentially treated by the liquid. After about 15 minutes the aluminium shims will have been preferentially etched to a depth of 0.003 inch below the surface of the unaffected stainless steel shims.

The roller may have a saw-tooth section as shown in FIG. 8, the depth of grooves 53 being say 0.003 inch and the groove width being 0.0006 inch and the flats separating the grooves being 0.001 inch in width. This form of roller will produce triangular-section filaments from a web 0.0014 inch thick. Such a roller may be produced by the following method:

A steel cylinder of 3.245 inches diameter is machined with a tungsten carbide cutting tool traversed so as to produce a continuous helical groove across the surface of the cylinder. A 0.001 inch land is left between groove edges to ensure constant diameter. After machining, the cylinder is hard chromium plated to 4.15 inches diameter.

A roller for producing triangular frustum filaments may be produced as follows:

A magnesium cylinder of diameter 3.25 inches is coated with Kodak Photo Resist and exposed to white light through a photographic film mask comprising 0.003 inch opaque lines separated by clear film of width 0.0015 inch. After exposure the resist is developed with Kodak Etch Developer to leave lines of hardened resist 0.0015 inch wide separated by a distance of 0.003 inch. The cylinder is then subject to the "Dow Etch" process (Powderless Etch) to etch the exposed magnesium surfaces to a depth of 0.003 inch without undercutting.

Another form of forging roller is produced by winding a single wire 54 in a helical locus on the surface of a plain cylinder as shown in FIG. 9 or by winding multiple wires 55, 56 as shown in FIG. 10. The wires may be wound directly as shown in FIG. 9, the spacings being adjusted during laying by a traversing mechanism geared to the cylinder rotation and the wire retained in position by tension or adhesives. Alternatively the cylinder may be grooved as at 57 in FIG. 10 in helical fashion at the required spacing and the wire laid in the groove and retained therein by tension alone. In FIG. 10 the wire 56 is of nickel and the wire 55 is hardened stainless steel. The advantage of using a nickel underlayer is that if any slight variation exists in the machined groove, under forging pressure the nickel will deform to compensate. Also, if deformation of the nickel is allowed to take place, a good anchorage will be obtained. FIGS. 11 and 12 show the forged film resulting from using these rollers with plain counter rollers. FIG. 13 shows a trilobal profile resulting from using a wire-wound counter roller.

In all the figures depicting the forged film profile, it will be observed that they have very small discrete cross-section areas which extend longitudinally through the web without interruption.

The rollers may be arranged to produce filaments having a main trunk and fibrils at intervals along the length of the main trunk.

Figure 14:
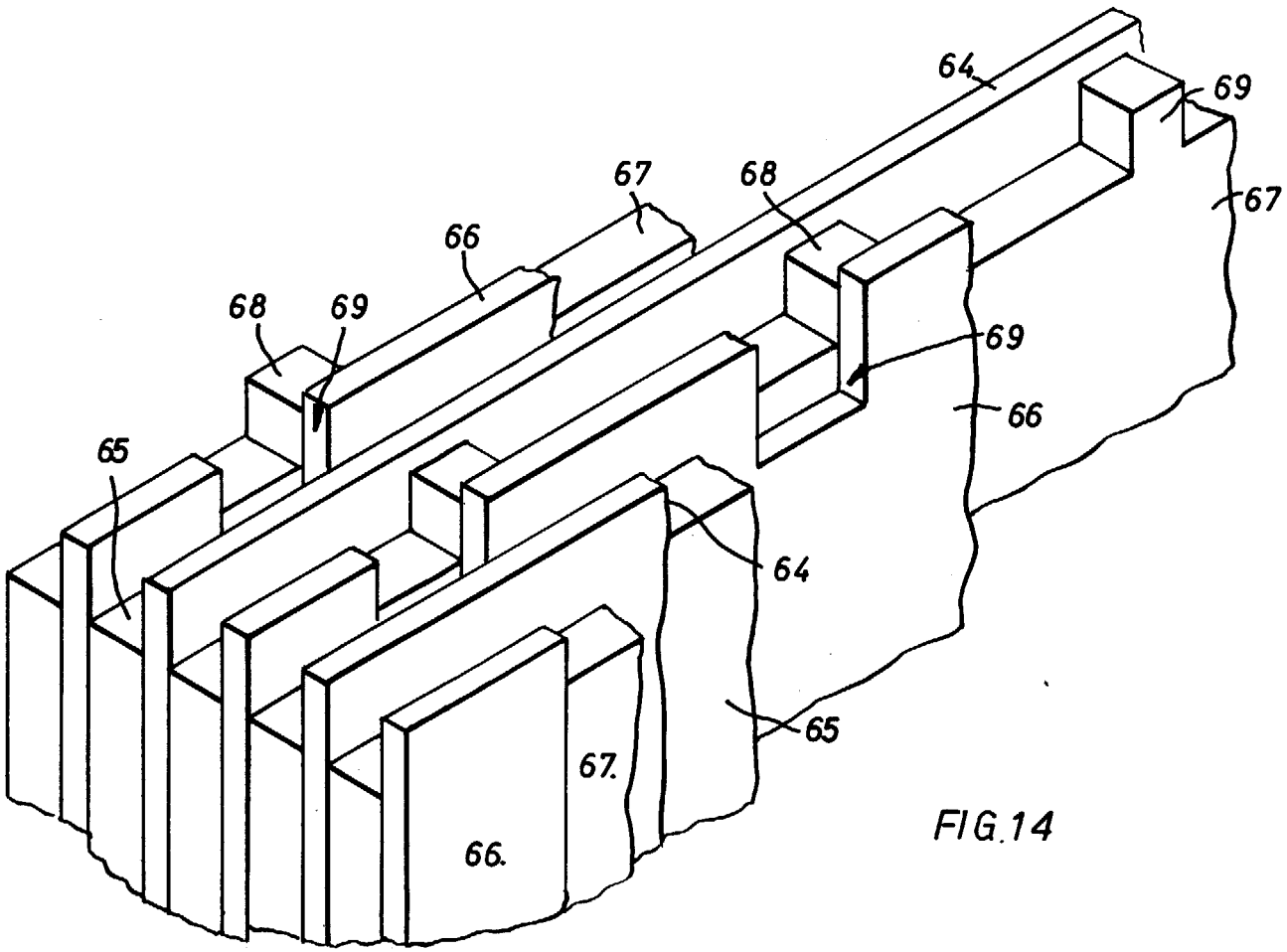

A part of the periphery of one form of forging roller for this purpose is shown on a much enlarged scale in FIG. 14.

In this construction there are spacer discs 64 of large diameter and plain periphery, spacer discs 65 of smaller diameter and plain periphery, notched discs 66 of large diameter, and smaller-diameter discs 67 having angularly-spaced castellations 68 which are angularly offset from the notches 69 of the discs 66. The main trunk of the filament is formed between the discs 64, 65, 66 and the fibrils are formed between the discs 66, 67 and 64. The lengths of the fibrils are determined by the spacing of the castellations 68 and the roots of the fibrils connecting them to the trunk are formed by the notches 69.

FIG. 15 and FIG. 16 which is a plan view of FIG. 15, show diagrammatically another way of forming fibrils on a main trunk. In this form small-diameter spacers (not shown) are used to separate thin discs of generally larger diameter. Some of these discs have plain peripheries, others, of which one is shown at 122, have peripheries formed with circumferentially-directed tongues 126 bent out of the plane of the disc.

Such an arrangement can utilise pairs of a single form of tongued disc 122, the two discs of each pair being reversed in the sense that the tongues of one disc extend towards and interdigitate with the tongues of the other disc.

Figure 19:
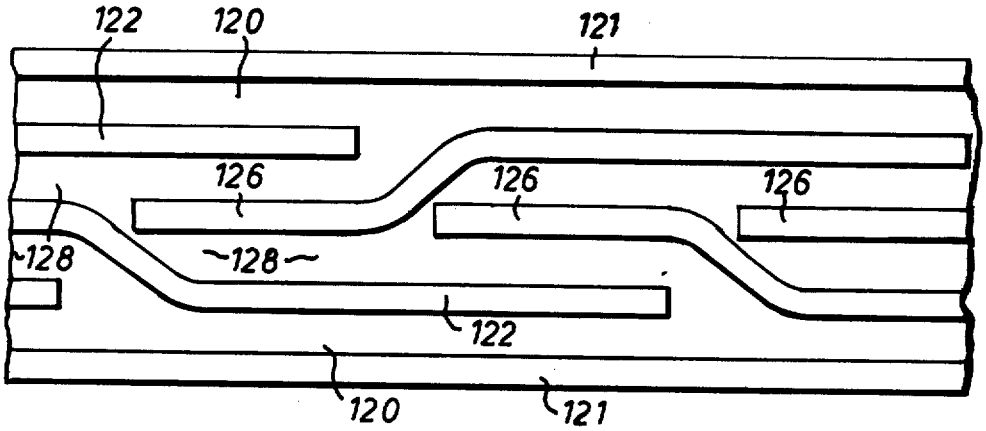
Figure 20:
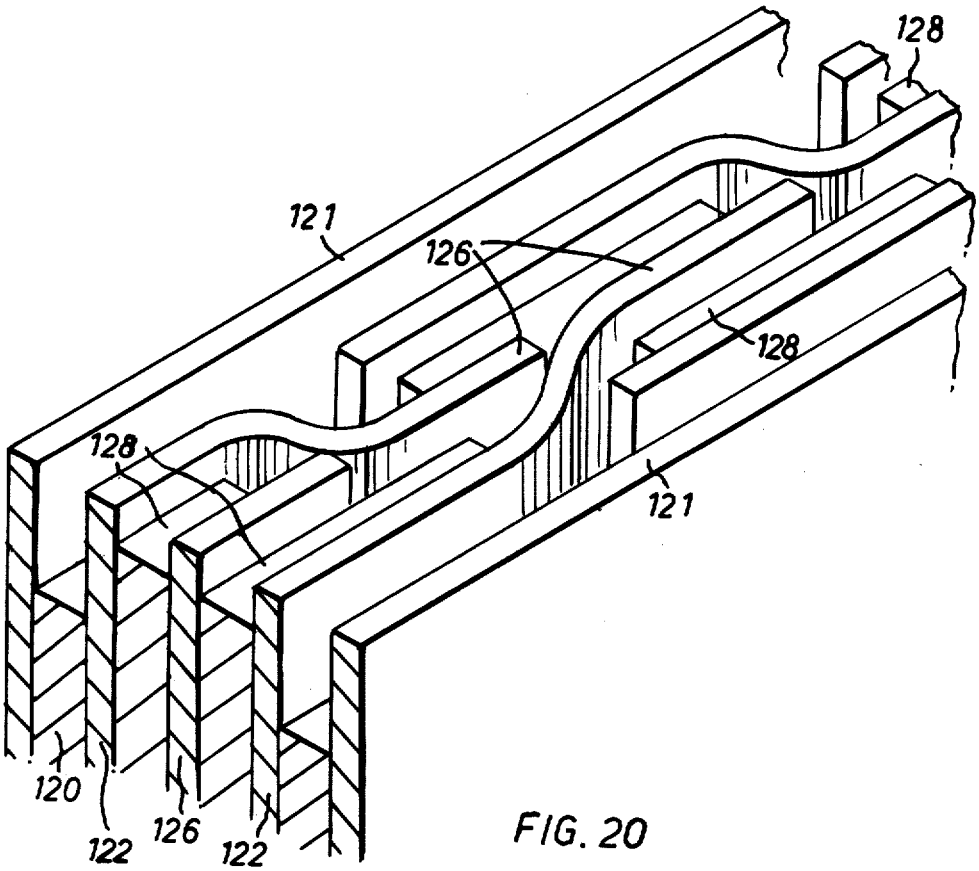

FIG. 17 shows diagrammatically a web forged by the disc arrangement of FIGS. 19 and 20, and indicates the form of main trunk filaments 129 and fibrils 130 produced. It will be appreciated that from the spaces between the main trunk filaments 129 and fibrils 130, the material of the web has been displaced by the discs arrangement shown in FIGS. 19 and 20, and to illustrate this some reference numerals and leading lines are inserted in FIG. 17 to said spaces, for indicating the disc parts which forged the spaces.

FIG. 18 shows diagrammatically, in the same manner as FIG. 17 but to a smaller scale, a narrow web forged to have main trunk filaments 131, 132, 133 and 134, of which filaments 131 and 134 have fibrils 135 and 136 respectively along one side only, whereas filaments 132 and 133 have fibrils 137 along both sides. It will be appreciated that the spaces between the main trunk filaments and the fibrils represent areas from which the material of the web has been displaced by a disc arrangement which includes discs with peripheries formed with circumferentially-directed tongues bent out of the planes of the discs, as at 126 in FIGS. 15, 16, 19 and 20.

FIGS. 19 and 20 show an arrangement utilising plain discs 121, plain spacer discs 120, and discs 122 with circumferentially-directed tongues 126 bent out of the planes of the discs. In this case, the tongues 126 determine the fibril lengths. Such an arrangement can utilise pairs of a single form of tongued disc 122, the two discs of a pair being reversed with respect to one another. The spacer discs 120 determining the thickness of the fibrils may have radial projections 128 so that the fibrils are thinner than the main trunks of the filaments.

The discs forming the rollers may conveniently be produced by a high-energy-rate pressing or stamping because this method will give clean-cut edges and dimensional accuracy.

We claim:

1. Process for the production of filaments for textile yarns from synthetic thermoplastic materials which are formable into webs and capable of being converted into filaments by division into narrow strips and stretching to many times their original length, comprising subjecting a film web of the material to forging to effect local weakening along parallel lines by passing the web between a non-yielding profiled roller and a non-yielding counter roller, at least the counter roller being heated to a temperature effective to soften the web to a forgeable condition, such that the thickness of the film web is greatly locally reduced to produce the lines of weakness by simultaneous deformation and lateral displacement of material into the regions between the lines of weakness, and thereafter at least partially converting the forged film web to filaments by rupture along the lines of weakness by stretching the film web longitudinally of the lines of weakness.

2. Process as claimed in claim 1 wherein the non-yielding counter roller is a plain roller.

3. Process as claimed in claim 2 further comprising chilling the web immediately following the forging step before said stretching to effect said rupture.

4. Process according to claim 3, comprising heating both the profiled roller and the counter roller, the counter roller being heated to a higher temperature than the profiled roller and the film web being fed into contact with the counter roller prior to contacting the forging roller.

5. Process according to claim 3, comprising also stretching the film web laterally to assist division.

6. Process according to claim 4, comprising also streching the film web laterally to assist division.

7. Process according to claim 3, comprising feeding the film web to the forging step under constant low tension and in flat stress-free form.

8. Process according to claim 3, comprising also assisting converting the forged film web to filaments by mechanical means.

9. Process according to claim 3, comprising extruding the synthetic thermoplastic material to form the film web, chilling the web, drawing the chilled web to reduce its cross-sectional dimensions, and edge trimming the web before feeding it to the forging step.

10. A process as claimed in claim 1 wherein said counterroller is a plain roller at a temperature higher than said profiled roller, and said film web is fed into contact with said counterroller prior to contacting said profile roller.

11. A process as claimed in claim 10 wherein said film web is caused to remain in contact with said relatively cooler profile roller after passing between and being forged by said rollers and passing out of contact with said relatively hotter counter-roller.

12. A process as claimed in claim 11 wherein said web is cooled to ambient temperature immediately following the forging step.

13. A process as claimed in claim 12 wherein said lines of weakness are continuous and uninterrupted throughout the length of the web.

* * * * *